US008205621B1

(12) United States Patent
Seeley

(10) Patent No.: US 8,205,621 B1
(45) Date of Patent: Jun. 26, 2012

(54) SMOKING DEVICE FOR AIDING CESSATION OF SMOKING

(76) Inventor: Wayne Seeley, Leicester, NY (US)

( * ) Notice: Subject to any disclaimer, the term of this patent is extended or adjusted under 35 U.S.C. 154(b) by 0 days.

(21) Appl. No.: 13/311,911

(22) Filed: Dec. 6, 2011

Related U.S. Application Data

(60) Provisional application No. 61/436,867, filed on Jan. 27, 2011.

(51) Int. Cl.
*A24F 47/00* (2006.01)

(52) U.S. Cl. ..... 131/272; 131/336; 131/335

(58) Field of Classification Search ..... None
See application file for complete search history.

(56) References Cited

U.S. PATENT DOCUMENTS 3,236,243 A * 2/1966 Robins ..... 131/339
3,323,525 A 6/1967 Miller
3,490,461 A 1/1970 Osmalov et al.
4,593,707 A 6/1986 Seidel et al.
5,472,001 A * 12/1995 Nicholson ..... 131/187

* cited by examiner

*Primary Examiner* — Richard Crispino
*Assistant Examiner* — Michael J Felton
(74) *Attorney, Agent, or Firm* — Tracy Jong Law Firm; Tracy P. Jong; Cheng Ning Jong

(57) ABSTRACT

A smoking device configured for controlling smoke/ambient air ratio for use by a user, the smoking device comprising a cigarette holder having a first passage, wherein the first passage includes a receiver portion and an exit portion. The smoking device further comprises a mouthpiece having a second passage and a third passage, wherein the first passage is fluidly connected to the second passage at the exit portion of the first passage. The third passage is normally unenclosed when not in use and becomes enclosed as a result of cooperation between the mouthpiece and a user's mouth and smoke generated from said cigarette is configured to be drawn through the first and second passages at a first flowrate and ambient air is configured to be drawn through the third passage at a second flowrate, into the user's mouth.

16 Claims, 7 Drawing Sheets

SMOKING DEVICE FOR AIDING CESSATION OF SMOKING

RELATED APPLICATIONS AND PRIORITY CLAIM

This application claims priority to provisional application U.S. Ser. No. 61/436,867 filed Jan. 27, 2011. Said application is incorporated by reference herein in its entirety.

BACKGROUND OF THE INVENTION

1. The Field of the Invention

The present invention is directed generally to a smoking device and more particularly, to a smoking device for regulating the smoke/air ratio drawn into the mouth of a smoker during inhalation for weaning the smoker off cigarettes.

2. Background Art

In recent years, there has been a boom in growth for products designed to assist a smoker in stopping smoking. From patches to prescriptions, nicotine delivery systems, herbal treatments, supplements, chewing gum, and lozenges, the options seem endless. Billions of dollars are being spent by government agencies, the insurance industry, medical organizations and the pharmaceutical industry to assist individuals addicted to the habit of smoking in cessation of smoking.

Various means of introducing the air steam into the cigarette are known, for example, the tobacco cylinder wrap can be a very porous paper which allows for aspiration of air therethrough and into the tobacco cylinder where it commingles with the smoke stream or, the tobacco cylinder may be perforated at locations along the length thereof which provides radial access ports to the tobacco cylinder through which ventilating air streams enter the cigarette. It is also known to provide ventilating air streams through annular cavities where the smoke stream is first commingled with the ventilating air streams only upon delivery of each to the smoker's mouth. Several devices for ventilating cigarettes were previously disclosed as shown below. However, none of them are capable of meeting the need for a simple, easy to clean and fail proof device for enabling commingling of smoke and air in the user's mouth.

U.S. Pat. No. 3,490,461 to Osmalov et. al. discloses a device for smoke filtration of a filter type and a non-filter type cigarettes. A filter cigarette is provided with a tubular mouthpiece at the rear end of the filter section, the mouthpiece having at least one central passage therethrough providing a flow path for the smoke stream so that the latter passes unimpeded from the filter section to the smoker's mouth. The mouthpiece is also provided with one or more separate ventilation passages formed in the body of the mouthpiece at or adjacent the periphery thereof the arrangement being such that the smoke passage and ventilation passages extend in the same general direction. The outlets of each ventilation passage communicate directly with the smoker's mouth so that the ventilating air stream and smoke stream are each delivered separately to the mouth, the ventilation passages also being provided with inlets in communication with the atmosphere. This disclosure fails to contemplate the possibility that the air conduits may be inadvertently blocked in use, reducing the effectiveness of the ventilation passages. This disclosure also lacks ventilation passages that are accessible for cleaning and a cigarette receiver portion that is conically configured to more securely hold a cigarette.

U.S. Pat. No. 4,593,707 to Seidel et. al. discloses a variably ventilatable filter cigarette with a filter body having a plurality of spaced circumferential, peripheral channels covered by a wrapping sheet at least a portion of which is air permeable, the wrapping sheet extending beyond the filter body to receive a cup-shaped member having an end wall with perforations alignable with the channels. The cup-shaped member is rotatable to vary the degree of registration with respect to the channels. This reference also discloses an ambient air flow path that is separated from the smoke flow path. It further discloses a mechanism for varying ventilation. However, there is an inner area (42 of '707) which receives filtered smoke and air where mixing takes place. This reference lacks the teaching of separate flow paths for delivering smoke and air to the mouth of a smoker. Such mixing within an area prior to reaching a user's mouth, provides a smoke/air mixture that tastes differently to the user than separate flows of air and smoke in the user's mouth. Therefore, this departure from conventional taste may dissuade the use of such device.

U.S. Pat. No. 3,323,525 to Miller discloses a cigarette holder or tip for admitting air into the smoke stream. One end of this holder is in the form of a bit adapted to be held in the smoker's mouth and the other end is adapted to receive the cigarette. The cigarette holder is hollow so that the bit or tip portion receives smoke flowing from the burning cigarette during smoking and passageway means are provided through which air from the outside of the cigarette may pass into the hollow tip in response to the smoker applying suction to the interior of the tip. Since suction in the tip draws air from both the outside and through the cigarette at the same time, the amount of air drawn through the burning portion of the cigarette is less than the amount that would be drawn if the entire suction were applied to the cigarette. Accordingly, less oxygen is drawn into the burning portion of the cigarette so that the burning temperatures are less and generally will not be excessive. This lowering of the burning temperature causes a reduction in the production of harmful tars in the burning zone. Moreover, since the smoke passing through the tobacco is at a lower temperature, there will be less production of tobacco tars. This disclosure is yet another example of a device which allows ambient air to be drawn from a flow path distinct from that of the smoke flow path. Again however, the smoke and air are mixed prior to entering the mouth of a smoker. It also lacks the teaching of an ambient air intake that is easily accessible for cleaning.

The prior art devices are not entirely satisfactory and in general are significantly more complicated in operation and construction and therefore much less cost effective in production and lacking in simplicity and human factors design. There arises a need for a smoking device comprising air or smoke passages that are accessible for cleaning, a cigarette holder that securely holds a cigarette, a mouthpiece design which prevents inadvertent blocking of ambient air passages and ergonomic mouthpiece design that makes the mouthpiece comfortable to hold in a user's mouth.

SUMMARY OF THE INVENTION

The present invention pertains to a device for holding a cigarette during consumption and regulating the smoke/air ratio drawn into the smoker's mouth. Specifically, the smoking device provides a truncated conical cigarette holder and a mouthpiece extending from the holder, wherein the smoking device has a means for mixing air with the smoke drawn from a cigarette and varying the smoke/air ratio in the smoke/air mixture, at the specific point where the smoke and air enter the user's mouth.

More specifically, a smoking device is provided for controlling smoke/ambient air ratio for use by a user. The smoking device comprises a cigarette holder having a first passage, wherein the first passage includes a receiver portion and an exit portion. The smoking device further comprises a mouthpiece having a second passage and a third passage, wherein the first passage is fluidly connected to the second passage at the exit portion of the first passage and the third passage is normally unenclosed when not in use and becomes enclosed as a result of cooperation between the mouthpiece and a user's mouth. Smoke generated from the cigarette is configured to be drawn through the first and second passages at a first flowrate and ambient air is configured to be drawn through the third passage at a second flowrate, into the user's mouth. The mouthpiece further comprises a protrusion configured to extend the third channel and prevents the third channel from being blocked during use of the user.

The first channel comprises a generally diminishing cross-sectional area from the receiver portion to the exit portion and a reducer disposed between the receiver portion and the exit portion. The reducer causes an abrupt decrease in diameter of from about 0.24 inch to about 0.22 inch. The size of the second passage is alterable to effect a change in the first flowrate/second flowrate ratio.

Accordingly, it is a primary object of the present invention to provide a smoking device which enables a constant ratio of ambient air/smoke flowrate to a user's mouth.

It is another object of the present invention to provide a smoking device that is simple in design, simple to fabricate and having features that are accessible to rinsing, cleaning and air drying.

It is yet another object of the present invention to provide a smoking device where the third (ambient air) passage remains unblocked or fail proof against inadvertent positioning of the user's lip.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—smoking device
3—barrel
4—cigarette holder
5—longitudinal axis
6—mouthpiece
7—receiver portion
8—exit portion
10—reducer
12—smoke channel
14—aperture
16—air channel
18—elongate guide plate
20—step
22—beam
24—length of cigarette holder
26—smoke flow
28—diameter of cigarette holder opening
30—slant angle
32—width of guide plate
34—diameter of barrel
35—height of mouthpiece
36—protrusion of guide plate over proximal end of barrel
38—combined length of cigarette holder and mouthpiece
40—mouth
42—mouth cavity
44—air flow
46—cigarette

47—cigarette filter
48—upper lip
50—lower lip
52—proximal end of barrel
54—distal end of barrel
56—truncated planar roof

Particular Advantages of the Invention

The present smoking device provides a structure that is simple in design, simple to fabricate and clean as the various features, e.g., the first, second and third passages are easily accessible. The ambient air flow passage (or the third passage) is constructed in the form of two channels with their openings exposed for easy access while not in use. Any contaminations such as biofluids of the mouth, e.g., saliva or other secretion from the mouth can be easily removed with running water or boiling water if so desired. The present embodiments lend themselves to injection molding as the receiver portion, guide plate, beam, barrel and aperture are easily formed with a single stage mold effected along the longitudinal axis of the smoking device.

One embodiment of the present smoking device comprises a protrusion extending beyond the proximal end of the barrel to prevent the user's lips from blocking air channels while the smoking device is in use.

DETAILED DESCRIPTION OF A PREFERRED EMBODIMENT

Figure 1:
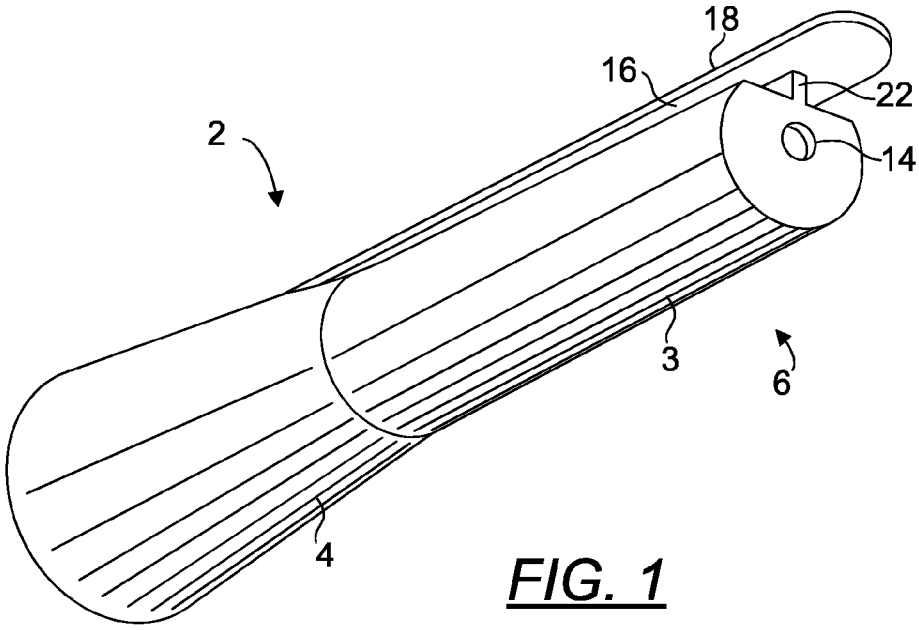
FIG. 1 is a bottom rear perspective view of a smoking device according to the present invention.
Figure 2:
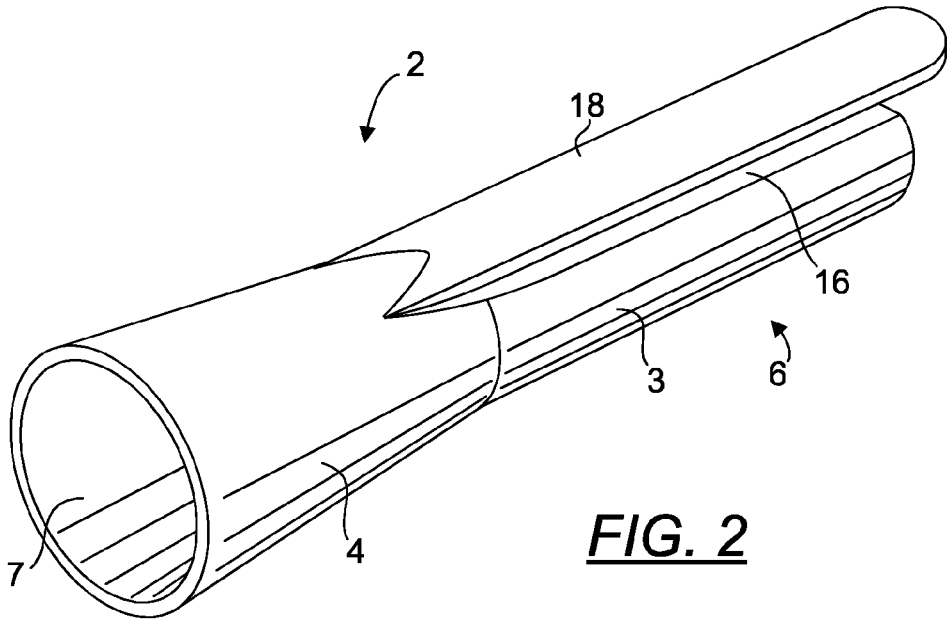
FIG. 2 is a top front perspective view of a smoking device according to the present invention.
Figure 3:
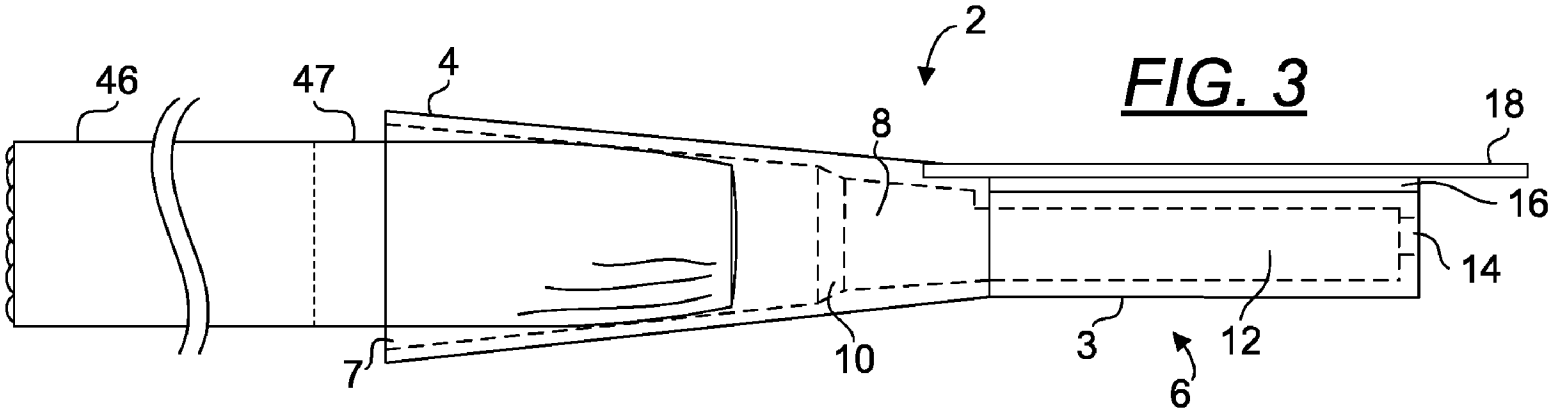
FIG. 3 is a side orthogonal transparent view of a smoking device according to the present invention, depicting the use of a large diameter cigarette filter.

FIGS. 1 and 2 are bottom rear and top front perspective views, respectively, of a smoking device according to the present invention. FIG. 3 is a side orthogonal transparent view of a smoking device according to the present invention depicting the use of a large diameter cigarette filter 47. The smoking device 2 is configured for controlling smoke/ambient air flowrate ratio for use by a user. The smoking device 2 comprises a cigarette holder 4 having a first passage, wherein the first passage includes a receiver portion 7 and an exit portion 8, wherein the receiver portion 7 is fluidly connected to the exit portion 8. The holder 4 is an enlarged end configured to accept a variety of various size cigarettes while the mouthpiece 6 is configured narrower such that it may be fit comfortably into a user's mouth. The truncated conical configuration of the holder 4 allows the user to securely place and position the filter 47 of a cigarette 46 into the holder 4. As the filter 47 is pushed towards to the holder 4, it begins to compress and uniformly deforms against the inner wall of holder 4. This compressive force stabilizes the filter portion of the cigarette for smoking and also reduces the amount of smoke entering the first passage. A larger diameter cigarette filter 47 is seated in the receiver portion 7, eliminating any potential burning problems that can be caused by a burning cigarette coming in contact with the holder 4. A filter 47 belonging to a consumed cigarette 46, extends at least about 0.40 inch beyond the receiver portion 7 opening.

Figure 4:
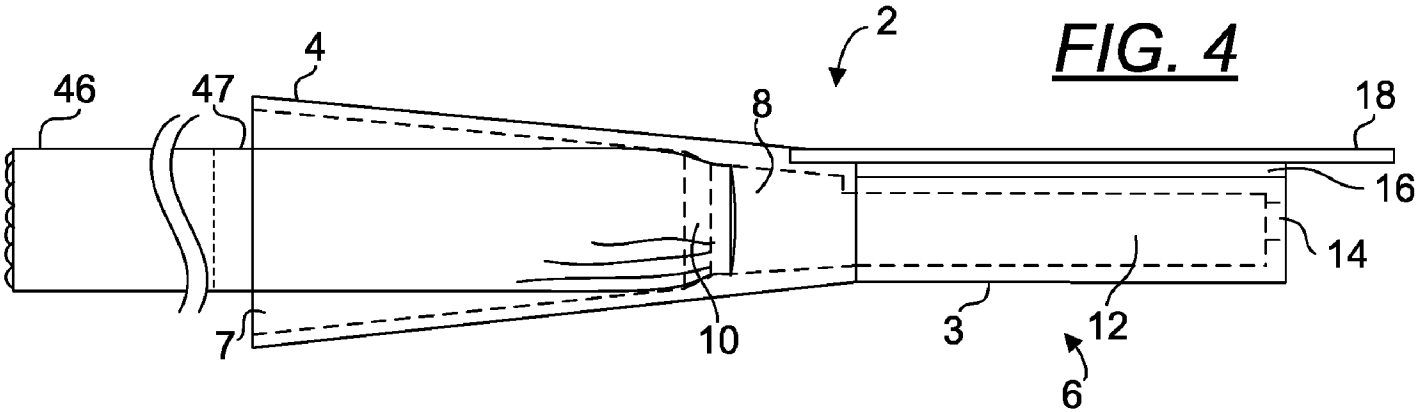
FIG. 4 is a side orthogonal transparent view of a smoking device according to the present invention, depicting the use of a small diameter cigarette filter.

FIG. 4 is a side orthogonal transparent view of a smoking device according to the present invention, depicting the use of a small diameter cigarette. The first passage comprises a generally decreasing cross-sectional area from the receiver portion 7 to the exit portion 8 and a reducer 10 disposed between the receiver portion 7 and the exit portion 8, wherein the reducer 10 causes an abrupt decrease in diameter of from about 0.24 inch to about 0.22 inch. Such abrupt decrease in diameter provides a means for securely holding a cigarette having a smaller diameter as shown in FIG. 4. The filter portion of the cigarette is shown compressed and thus conforms to the shape of the receiver portion 7, reducer 10 and exit portion 8 of the holder 4.

Figure 5:
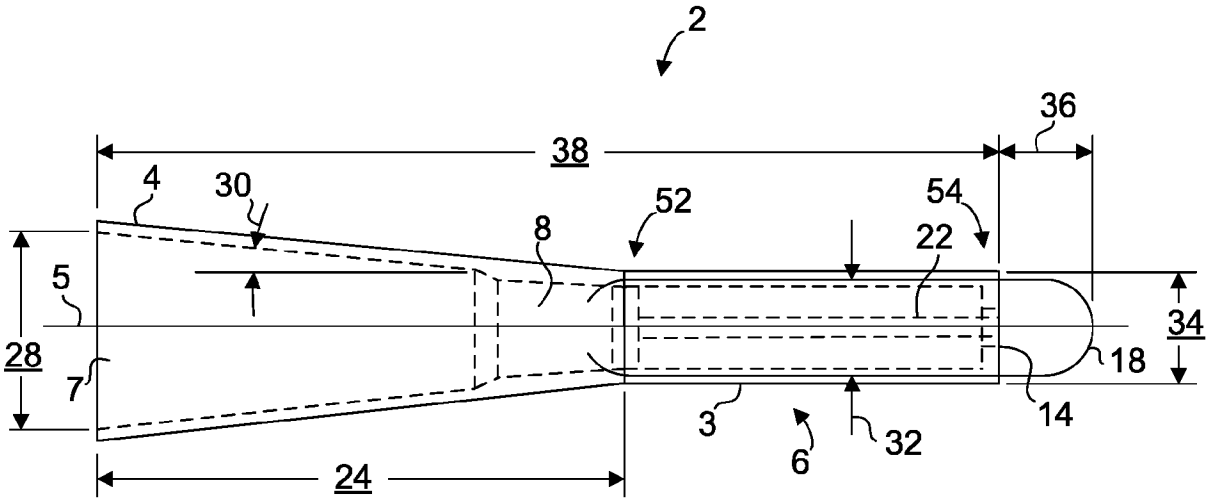
FIG. 5 is a top orthogonal transparent view of a smoking device according to the present invention.
Figure 7:
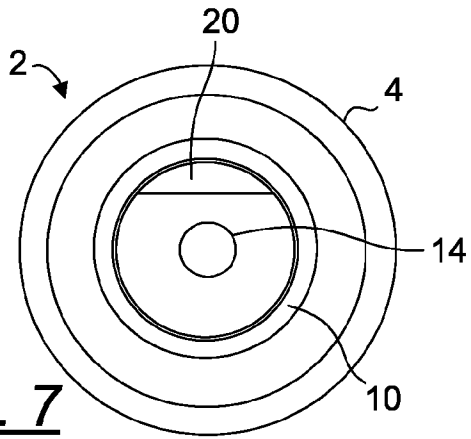
FIG. 7 is a front orthogonal view of a smoking device according to the present invention.
Figure 6:
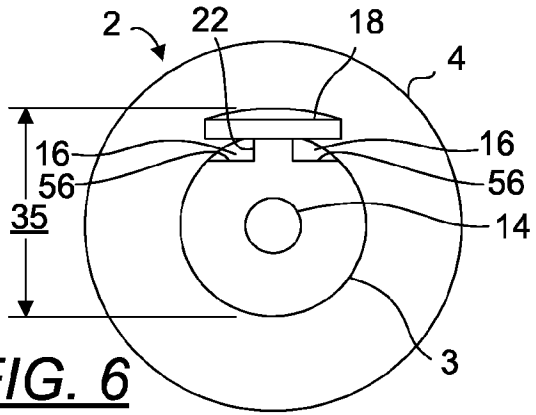
FIG. 6 is a rear orthogonal view of a smoking device according to the present invention.
Figure 9:
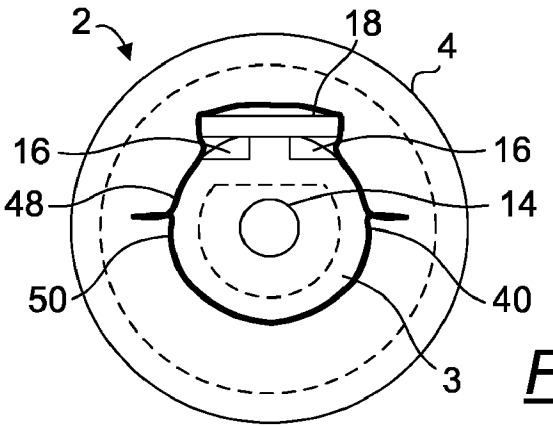
FIG. 9 is a rear orthogonal transparent view of a smoking device according to the present invention, depicting the smoking device in its in use condition.

FIG. 5 is a top orthogonal transparent view of a smoking device 2 according to the present invention. FIGS. 6 and 7 are rear and front orthogonal views, respectively, of a smoking device 2 according to the present invention. The smoking device 2 further comprises a mouthpiece 6 having a second passage (or smoke channel 12) and a third passage (or air channels 16). The mouthpiece 6 is a generally cylindrical barrel 3 truncated along a longitudinal edge with a planar roof 56. The barrel 3 comprises a distal end 52 and a proximal end 54. Referring to FIGS. 6 and 7, two horizontally and opposingly disposed air channels 16 are formed by disposing a guide plate 18 atop a beam 22 which is in turn centrally disposed atop the planar roof such that the guide plate 18 is disposed at an offset and in a substantially parallel relationship to the planar roof. The beam 22 connects the guide plate 18 longitudinally to the planar roof 56. One or both of such channels 16 form the third passage. Each air channel 16 is normally unenclosed when the smoking device 2 is not in use and it becomes enclosed as a result of cooperation between the mouthpiece 6 and the user's mouth as depicted in FIG. 9. In other words, when the mouthpiece 6 is held in the mouth, the lips 48, 50 surround the mouthpiece 6 such that a rather constant third passage is established and a fixed amount of air flow can be drawn into the mouth cavity 42 with each inhalation. The first passage is fluidly connected to the second passage at the exit portion 8 of the first passage and the distal end 52 of the barrel 3 to result in the first passage being axially aligned with the second passage. The guide plate 18 extends from a portion of the holder 4 and along the lengthwise direction of the barrel 3 towards the proximal end 54 of the barrel 3. At no point along the entire length of the mouthpiece 6 does the third passage come in contact with the second passage. Therefore the smoke flow 26 only commingles with the air flow 44 upon arriving inside the user's mouth cavity 42. The planar roof 56 appears as a step 20 when the smoking device 2 is viewed from its front end.

In a preferred embodiment as shown in FIG. 5, the diameter 28 of the receiver portion 7 opening measures about 0.39 inch. The length 38 of the smoking device 2, not including the protrusion measures about 1.81 inches. The length 24 of the holder 4 measures about 0.99 inch. Applicant discovered that such holder 4 length prevents a burning cigarette from coming into close proximity with the holder 4, thereby preventing fire hazards. The outer diameter 34 of the barrel 3 measures about 0.28 inch. The height 35 of the mouthpiece 6 measures 0.29 inch. The mouthpiece size is critical for comfort as a smoker is typically accustomed to a common cigarette diameter and would be reluctant to use a size and/or shape which deviates significantly from a typical cigarette size. Applicant discovered that a protrusion 36 of about 0.19 inch is suitable as this length does not affect user comfort but yet enabling its function to be realized. A slant angle 30 of from about 6 degrees to about 6.5 degrees was found to be suitable for receiving cigarettes of having diameters ranging from a large size of 0.35 inch to a small size of 0.24 inch. Exemplary aperture 14 diameters are 0.10 inch, 0.08 inch and 0.06 inch. The width 32 of the guide plate 18 measures about 0.19 inch.

Figure 8:
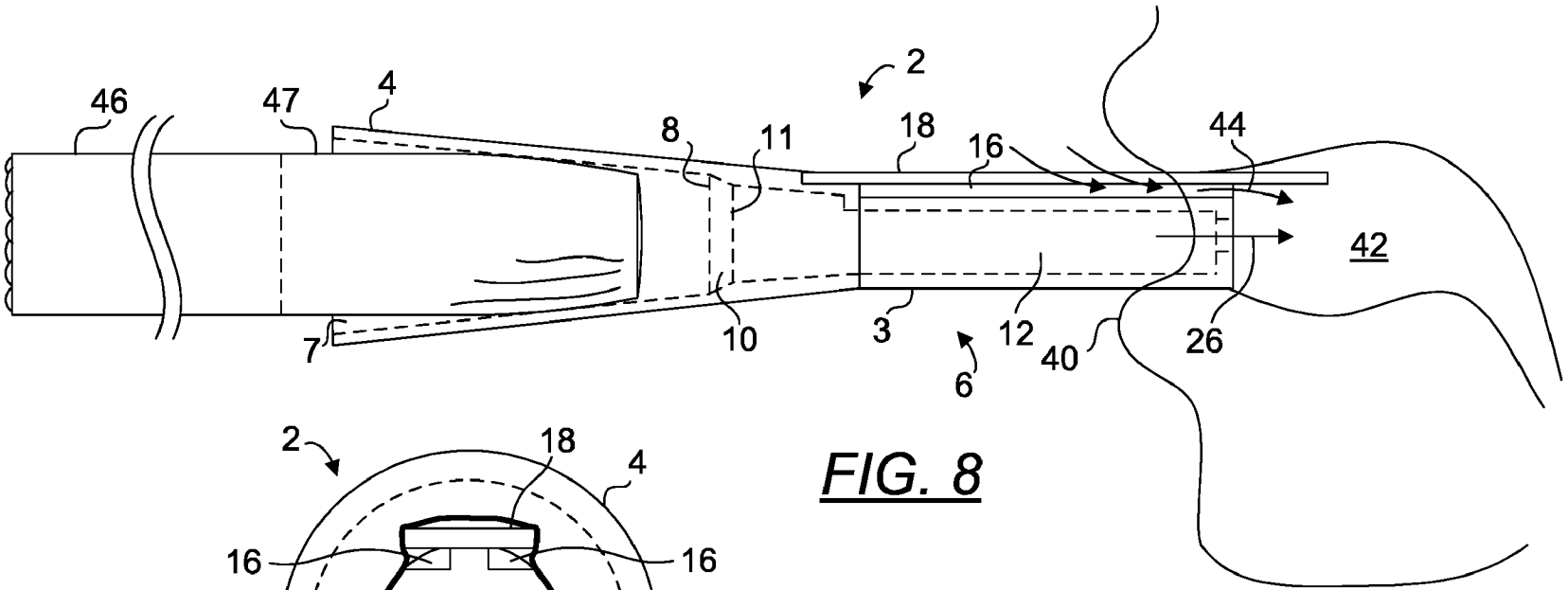
FIG. 8 is a side orthogonal transparent view of a smoking device according to the present invention, depicting the smoking device in its in use condition.

FIG. 8 is a side orthogonal transparent view of a smoking device 2 according to the present invention, depicting the smoking device in its in use condition. Smoke 26 generated from the cigarette is drawn through the first and second passages at a first flowrate and ambient air 44 is configured to be drawn through the third passage at a second flowrate, into the user's mouth cavity 42.

FIG. 9 is a rear orthogonal transparent view of a smoking device 2 according to the present invention, depicting the smoking device 2 in its in use condition. The outline of a user's mouth 40 is shown wrapped around mouthpiece 6, substantially encircling a periphery outlined by the top surface of the guide plate 18, a substantial portion of the bottom surface of the barrel 3 and the air channels 16, leaving the air channels 16 open to allow entry of ambient air into the user's mouth cavity 42. It shall be noted that, as the guide plate 18 extends beyond the proximal end 54 of the barrel 3, it prevents the user's upper lip 48 from blocking the air channels 16.

Figure 10:
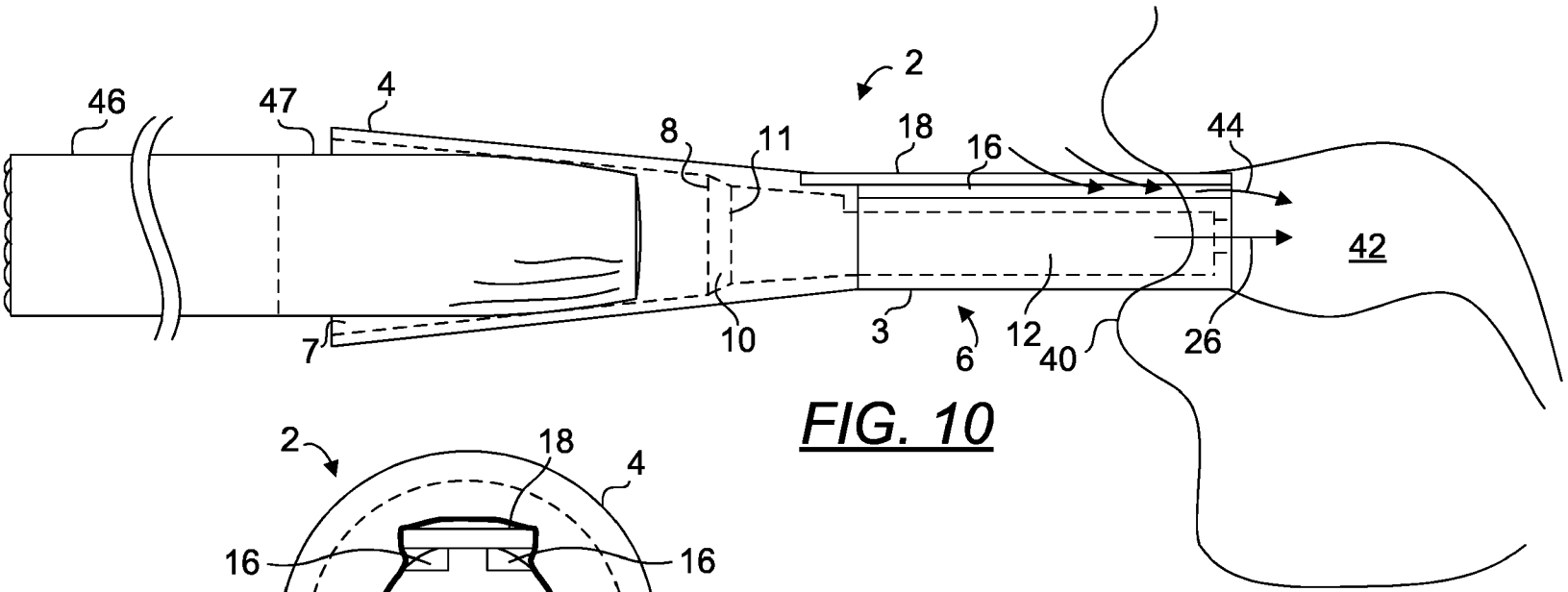
FIG. 10 is a side orthogonal transparent view of another embodiment of the present invention in its in use condition.
Figure 11:
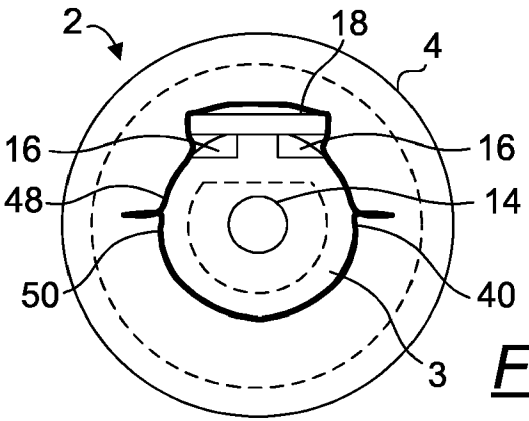
FIG. 11 is a rear orthogonal transparent view of the embodiment of FIG. 10.

FIG. 10 is a side orthogonal transparent view of another embodiment of the present invention in its in use condition. In this embodiment, the guide plate 18 terminates at and does not expand beyond the proximal end 54 of the barrel 3. This embodiment is used much the same way as the embodiment disclosed earlier. Ambient air 44 and smoke 26 are again pulled in through the third passage and the second passage respectively. Absent the protrusion of the guide plate 18 beyond the proximal end 54 of the barrel 3, some users may find this configuration more pleasing to use. FIG. 11 is a rear orthogonal transparent view of the embodiment of FIG. 10, depicting a substantially the same mouth-mouthpiece interaction as that of FIG. 9.

Figure 12:
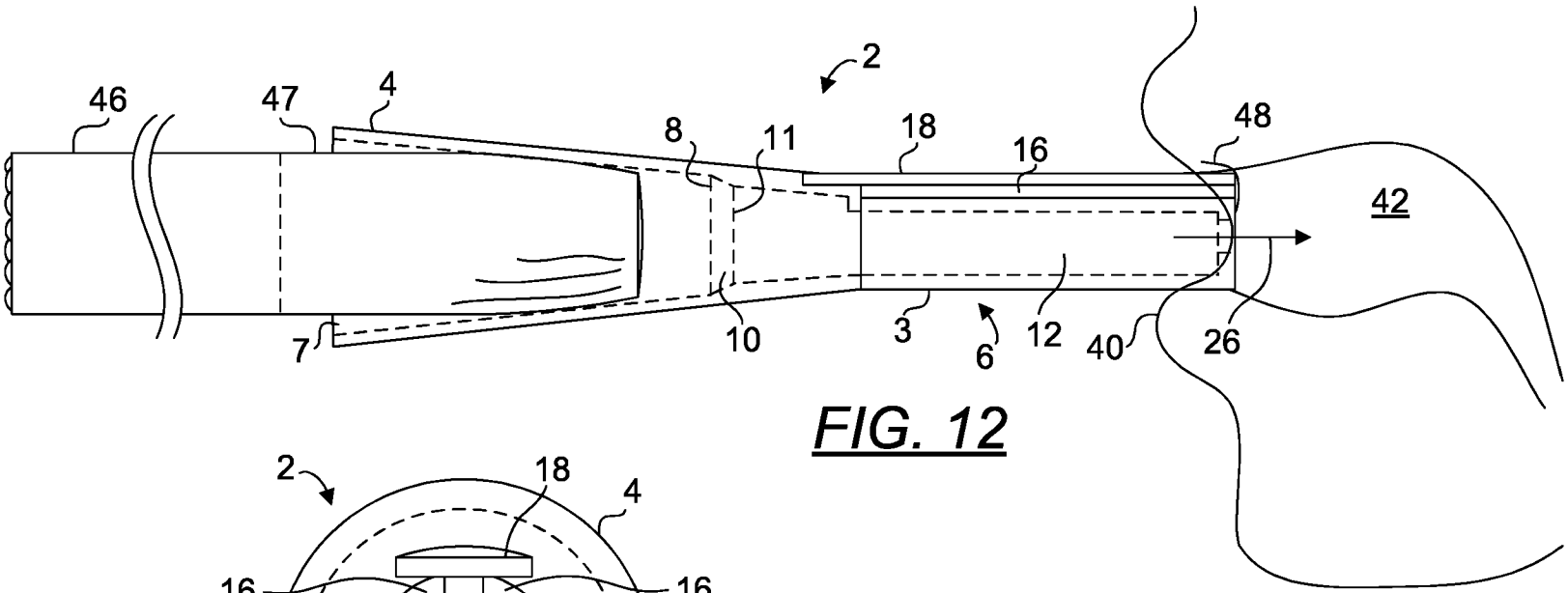
FIG. 12 is a side orthogonal transparent view of the embodiment of FIG. 10, depicting a circumstance in which such embodiment can be incorrectly used.
Figure 13:
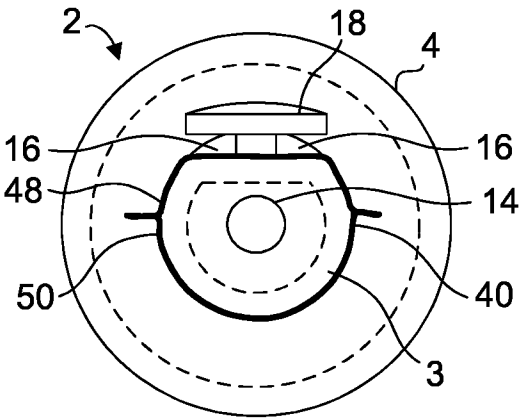
FIG. 13 is a rear orthogonal transparent view of the embodiment of FIG. 10, depicting a circumstance in which such embodiment can be incorrectly used.

FIGS. 12 and 13 are side and rear orthogonal transparent views, respectively, of the embodiment of FIG. 10, depicting a circumstance in which such embodiment can be incorrectly used. In this arrangement, there is insufficient engagement of the mouthpiece 6 by the mouth, causing the upper lip 48 to droop down and block the third passage and therefore the intake of ambient air 44. Although this embodiment is suitable for some, the embodiment of FIG. 8 is preferable for those who are inclined to cause blockage of the third passage by lightly holding the mouthpiece 6.

Figure 14:
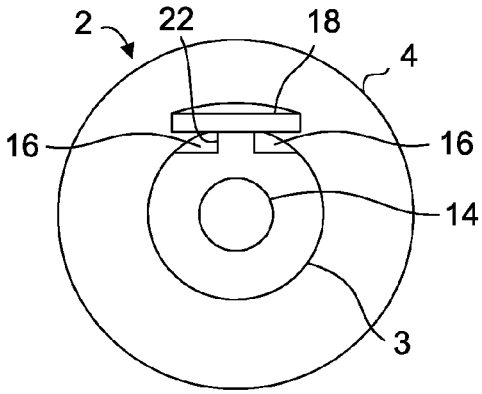
FIG. 14 is a rear orthogonal view of a smoking device according to the present invention, depicting a larger aperture for increasing smoke flowrate.
Figure 15:
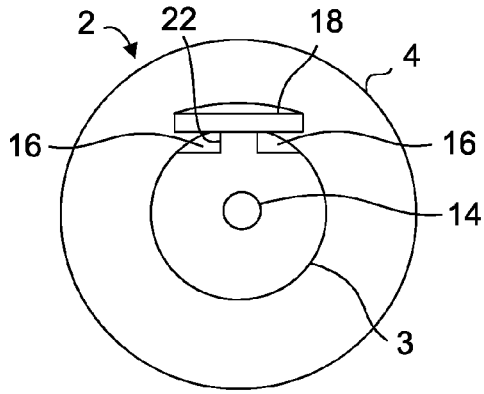
FIG. 15 is a rear orthogonal view of a smoking device according to the present invention, depicting a smaller aperture for decreasing smoke flowrate.

FIG. 14 is a rear orthogonal view of a smoking device 2 according to the present invention, depicting a larger aperture 14 for increasing smoke flow as compared to the embodiment in FIG. 6. FIG. 15 depicts a smaller aperture 14 for decreasing smoke flow as compared to the embodiment in FIG. 6. In practice, the smoking device 2 is used for weaning a smoker off cigarettes. In a typical quit smoking program using the present smoking device, the user will be presented a set of three smoking devices 2 which differ in the aperture 14 diameter. The user is encouraged to gradually wean off smoking habit by gradually reducing the amount of smoke drawn into the user's mouth. In one example, a three-month quit smoking program is proposed. Over the course of the first month, the smoking device 2 (with large aperture 14) of FIG. 14 will be used as it has the largest aperture 14 to cause the smallest reduction in the smoke flowrate. Over the course of the second month, the smoking device 2 (with medium aperture 14) of FIG. 6 will be used as it has an aperture 14 of a smaller size than the smoking device 2 of FIG. 14. Over the course of the third month, the smoking device 2 (with small aperture 14) of FIG. 15 will be used as it has the smallest aperture 14 of the smoking devices 2 of FIGS. 6, 14-15, thereby allowing the lowest smoke flowrate. The smoke/air flowrate ratios of a smoking device with large, medium and small apertures are about 70/30, 55/45 and 20/80, respectively. As the amount of air drawn in by the user increases over time, it is the wish of the program that by the fourth month, the user will be accustomed to not smoking at all.

Figure 16:
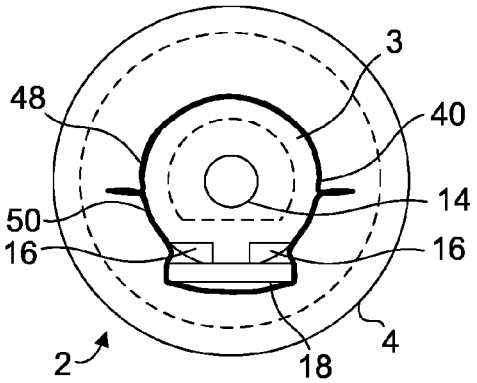
FIG. 16 is a rear orthogonal transparent view of a smoking device according to the present invention, depicting an orientation of the mouthpiece where the guide plate is disposed at the bottom and comes in contact with the lower lip of the user.
Figure 17:
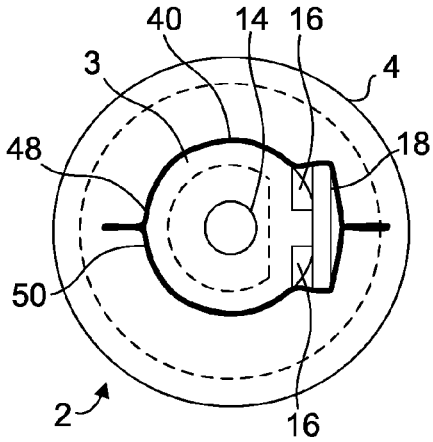
FIG. 17 is a rear orthogonal transparent view of a smoking device according to the present invention, depicting an orientation of the mouthpiece where the guide plate is laterally disposed and comes in contact with the upper and lower lips of the user.

FIG. 16 is a rear orthogonal transparent view of a smoking device according to the present invention, depicting an orientation of the mouthpiece 6 where the guide plate is disposed at the bottom and comes in contact with the lower lip 50 of the user. FIG. 17 depicts an orientation of the mouthpiece 6 where the guide plate is laterally disposed and comes in contact with the user's upper and lower lips 48, 50. These figures further illustrate that the orientation of the mouthpiece 6 with respect a user's mouth is unimportant as any mouthpiece 6 orientation enables the third passage to still function properly.

In one embodiment, the various components of the smoking device 2 were integrally formed as a single unit. In another embodiment, the guide plate 18 and beam 22 are constructed as a separate unit but fixedly attached to the cigarette holder 4 by means of interlocking the two separate parts. The present embodiments lend themselves to injection molding as the receiver portion 7, guide plate 18, beam 22, barrel 3 and aperture 14 are easily formed with a single stage mold effected along the longitudinal axis 5 of the smoking device 2. The smoking device 2 is constructed from a light weight and durable, heat resistant plastic capable of retaining its shape while a cigarette is being inserted in the holder 4 and when the mouthpiece 6 is held in the mouth. In one embodiment, such material is polyurethane. Suitable materials include such polymers as medical grade polycarbonate and Food and Drug Administration (FDA) approved plastic resin.

The present smoking device 2 is simple in design, simple to fabricate and has features that are accessible to rinsing, cleaning and air drying. The device 2 can therefore be maintained in a sanitary condition throughout its life. Further, the device is cost effective to fabricate and therefore can be readily provided to the consuming public.

I claim:

1. A smoking device configured for controlling smoke/ambient air ratio for use by a user, said smoking device comprising:

(a) a cigarette holder having a first passage, wherein said first passage includes a receiver portion and an exit portion; and (b) a mouthpiece having a protrusion, a second passage and a third passage, wherein said first passage is fluidly connected to said second passage at said exit portion of said first passage and said third passage is normally unenclosed when not in use and becomes enclosed as a result of cooperation between said mouthpiece and said user's mouth, smoke generated from said cigarette is configured to be drawn through said first and second passages at a first flowrate and ambient air is configured to be drawn through said third passage at a second flowrate, into said user's mouth and a ratio of said first and second flowrates determines the amount of dilution of said smoke and said protrusion is configured to extend about 0.19 inch from said third passage and prevents said third passage from being blocked during use by said user.

2. A smoking device configured for controlling smoke/ambient air ratio for use by a user, said smoking device comprising:

(a) a cigarette holder having a first passage, wherein said first passage includes a receiver portion and an exit portion and said first passage comprises a generally decreasing cross-sectional area from said receiver portion to said exit portion and a reducer disposed between said receiver portion and said exit portion, said reducer causes an abrupt decrease in diameter of from about 0.24 inch to about 0.22 inch; and (b) a mouthpiece having a second passage and a third passage, wherein said first passage is fluidly connected to said second passage at said exit portion of said first passage and said third passage is normally unenclosed when not in use and becomes enclosed as a result of cooperation between said mouthpiece and said user's mouth, smoke generated from said cigarette is configured to be drawn through said first and second passages at a first flowrate and ambient air is configured to be drawn through said third passage at a second flowrate, into said user's mouth and a ratio of said first and second flowrates determines the amount of dilution of said smoke.

3. A smoking device configured for controlling a smoke/ambient air ratio of a cigarette for use by a user, said smoking device comprising:

(a) a truncated conical cigarette holder having a length, a first passage defined by a receiver portion and an exit portion, wherein said receiver portion is fluidly connected to said exit portion and said holder is configured for holding the cigarette; and (b) a mouthpiece comprising:

a second passage defined by a generally cylindrical barrel truncated along one longitudinal edge with a planar roof, said barrel having a proximal end and a distal end; and a third passage defined by an elongate guide plate disposed at an offset and in a substantially parallel relationship to said planar roof and a beam connecting said guide plate to said planar roof longitudinally, wherein said distal end of said barrel is connected to said exit portion of said holder such that said first passage is fluidly connected to said second passage and said third passage is normally unenclosed when not in use and becomes enclosed as a result of cooperation between said mouthpiece and said user's mouth, smoke generated from said cigarette is configured to be drawn through said first and second passages at a first flowrate and ambient air is configured to be drawn through said third passage at a second flowrate into said user's mouth and a ratio of said first and second flowrates determines the amount of dilution of said smoke.

4. The smoking device of claim 3, wherein said mouthpiece further comprises a protrusion configured to extend said third passage and prevents said third passage from being blocked during use of said user.

5. The smoking device of claim 4, wherein said protrusion extends a distance of about 0.19 inch beyond said proximal end of said barrel.

6. The smoking device of claim 3, wherein said first passage comprises a generally decreasing cross-sectional area from said receiver portion to said exit portion and a reducer disposed between said receiver portion and said exit portion, said reducer causes an abrupt decrease in diameter of from about 0.24 inch to about 0.22 inch.

7. The smoking device of claim 3, wherein the flowrate through said second passage is alterable to effect a change in a ratio of said first flowrate to said second flowrate.

8. The smoking device of claim 7, wherein said ratio is alterable by changing said first flowrate.

9. The smoking device of claim 3, wherein said smoking device is constructed from a material selected from the group consisting of medical grade polycarbonate and FDA approved plastic resin.

10. The smoking device of claim 3, wherein said length of said holder is about 0.99 inch.

11. A smoking device configured for controlling a smoke/ambient air ratio of a cigarette for use by a user, said smoking device comprising:

(c) a truncated conical cigarette holder having a length, a first passage defined by a receiver portion and an exit portion, wherein said receiver portion is fluidly connected to said exit portion and said holder is configured for holding the cigarette; and (d) a mouthpiece comprising:

a second passage defined by a generally cylindrical barrel truncated along one longitudinal edge with a planar roof, said barrel having a proximal end and a distal end; and a third passage defined by an elongate guide plate disposed at an offset and in a substantially parallel relationship to said planar roof and a beam connecting said guide plate to said planar roof longitudinally, wherein said distal end of said barrel is connected to said exit portion of said holder such that said first passage is fluidly connected to said second passage and said third passage is normally unenclosed when not in use and becomes enclosed as a result of cooperation between said mouthpiece and said user's mouth, smoke generated from said cigarette is configured to be drawn through said first and second passages at a first flowrate, ambient air is configured to be drawn through said third passage at a second flowrate into said user's mouth, said mouthpiece further comprises a protrusion configured to extend said third passage and prevents said third passage from being blocked during use of said user and a ratio of said first and second flowrates determines the amount of dilution of said smoke.

12. The smoking device of claim 11, wherein said protrusion extends a distance of about 0.19 inch beyond said proximal end of said barrel.

13. The smoking device of claim 11, wherein said first passage comprises a generally decreasing cross-sectional area from said receiver portion to said exit portion and a reducer disposed between said receiver portion and said exit portion, said reducer causes an abrupt decrease in diameter of from about 0.24 inch to about 0.22 inch.

14. The smoking device of claim 11, wherein said ratio is alterable by changing said first flowrate.

15. The smoking device of claim 11, wherein said smoking device is constructed from a material selected from the group consisting of medical grade polycarbonate and FDA approved plastic resin.

16. The smoking device of claim 11, wherein said length of said holder is about 0.99 inch.

* * * * *